United States Patent [19]

Smith

[11] Patent Number: 5,064,201

[45] Date of Patent: Nov. 12, 1991

[54] METHOD OF PLAYING A BOARD GAME

[76] Inventor: Mark R. Smith, 1401 NW. 185th, Edmond, Okla. 73034

[21] Appl. No.: 507,999

[22] Filed: Apr. 11, 1990

[51] Int. Cl.[5] ..... A63F 3/00

[52] U.S. Cl. ..... 273/258; 273/264

[58] Field of Search ..... 273/242, 258, 260, 262, 273/264, 263, 242, 248–255, 258, 260, 261

[56] References Cited

U.S. PATENT DOCUMENTS

| | | | |
|---|---|---|---|
| 799,794 | 9/1905 | Larkey | 273/258 |
| 935,755 | 10/1909 | Grundy | 273/264 |
| 1,262,312 | 4/1918 | Dewante | 273/264 |
| 1,405,988 | 2/1922 | Erwin | 273/260 |
| 1,551,951 | 9/1925 | Haibloom | 273/251 |
| 2,799,504 | 7/1957 | Keyko | 273/260 |
| 3,672,680 | 6/1972 | Grey | 273/260 |
| 3,833,221 | 9/1974 | Van Tol | 273/243 |
| 4,613,134 | 9/1986 | Tobin | 273/242 |

FOREIGN PATENT DOCUMENTS

| | | | |
|---|---|---|---|
| 20256 | of 1890 | United Kingdom | 273/258 |

*Primary Examiner*—Benjamin Layno

*Attorney, Agent, or Firm*—Bill D. McCarthy; Glen M. Burdick

[57] ABSTRACT

A board game apparatus is provided wherein the players are challenged with an objective of advancing and arranging movable game pieces within certain designated areas on a game board without being captured by the opponent. The game apparatus comprises a game board having a playing surface consisting of a plurality of squares and boundary markings dividing the playing surface into a plurality of subset areas. A predetermined number of movable game pieces are positionable on designated starter squares and movable, in player turn, selected distances as defined by the subset areas in a first direction, a second direction or a diagonal direction to attain a first winning goal of capturing of a majority of the opponent's game pieces by coterminous moves to the same squares in any of the subset areas, or to attain second winning goal of being the first player to position the game pieces in an aligned first direction row, an aligned second direction row, or an aligned diagonal row in the center area of the game board.

2 Claims, 1 Drawing Sheet

METHOD OF PLAYING A BOARD GAME

BACKGROUND OF THE INVENTION

1. Field of the Invention

The present invention relates to a game apparatus, and more particularly, but not by way of limitation, to a board game apparatus in which a game board is provided having a plurality of squares which define subset areas, the subset areas dictating the distance a game piece travels in one of a vertical, horizontal or diagonal direction.

2. Brief Description of the Prior Art

The prior art is replete with board games having movable pieces which can be moved in one or more directions to capture the game pieces of opposing players or to arrange the game pieces in a desired configuration to effect a win. Larkey, U.S. Pat. No. 799,794, discloses a game apparatus having a game board and a number of game pieces. The game board is provided with a particular pattern and the game pieces, which may be captured by an opposing player, are moved in a patterned direction along the game board. The object of the game is to move the game pieces to designated positions on the game board and thereafter move the game pieces along a predetermined course to the center of the game board.

Grundy, U.S. Pat. No. 935,755, also discloses a game apparatus or a board game wherein the game may be played by up to four players. The game apparatus includes game pieces which are moved to capture an opponent's game pieces.

Dewante, U.S. Pat. No. 1,262,312, discloses a game board wherein the players manipulate game pieces to effect the capture of the opponent's game pieces. A player may also arrange three game pieces in a row to effect a win.

Grey, U.S. Pat. No. 3,672,680, and Van Tol, U.S. Pat. No. 3,833,221, each disclose a board game apparatus using various colored game pieces. The game pieces are manipulated by the players to positions on the game board where capture of an opponent's game piece may be effected.

While each of the above discussed prior art references discloses various types of board game apparatus wherein game pieces can be selectively moved to capture an opponent's game piece or arranged in a desired configuration to effect a win, new and improved board games are constantly being sought which can be easily learned, while at the same time will be intellectually challenging and provide the players with a stimulating exercise of mental competition. It is to such a board game apparatus that the present invention is directed.

SUMMARY OF THE INVENTION

According to the present invention a board game apparatus is provided wherein the players are challenged with an objective of advancing and arranging movable game pieces within designated areas on a game board without being captured by the opponent. Broadly, the game apparatus comprises a game board having a playing surface consisting of a plurality of squares and boundary markings dividing the playing surface into a plurality of subset areas. A predetermined number of movable game pieces are positionable on designated starter squares and movable, in player turn, selected distances along the game board. The distance a game piece can be moved is determined by the subset area where the game piece is located.

The squares on the playing surface are defined by orthogonally disposed grid lines extending in first and second directions, and the boundary markings are coincident with selected grid lines such that each of the subset areas is centered relative to an outer boundary of the playing surface. The subset areas are each assigned a selected value and one of the subset areas is a perimeter area, a second subset area is an intermediate area and a third subset area is a center area.

The designated starter squares on to which the movable game pieces are positioned are located in the perimeter area. The game pieces are movable a selected distance as defined by each of the subset areas in one of the first direction, the second direction and a diagonal direction, in player turn, to attain a first winning goal of capturing of a majority of the opponent's game pieces by coterminous moves to the same squares in any of the subset areas, or to attain a second winning goal, that is, to be the first player to position the game pieces in either an aligned first direction row, an aligned second direction row, or an aligned diagonal row in the center area of the game board which constitutes the third subset area.

An object of the present invention is to provide a game of skill for players who are challenged with an objective of advancing and arranging game pieces on a game board within designated areas without being captured by an opponent.

Another object of the invention, while achieving the before stated object, is to provide a board game apparatus wherein the outcome of the game is determined by skill and strategy rather than by chance.

Another object of the present invention, while achieving the before stated objects, is to provide a game which can be easily learned, yet intellectually challenges a discerning player.

Yet another object of the invention, while achieving the before stated objects, is to provide a board game apparatus which is simple in construction and inexpensive to manufacture.

Other objects, advantages and features of the present invention will become apparent from the following detailed description when read in conjunction with the appended claims.

DETAILED DESCRIPTION

Figure 1:
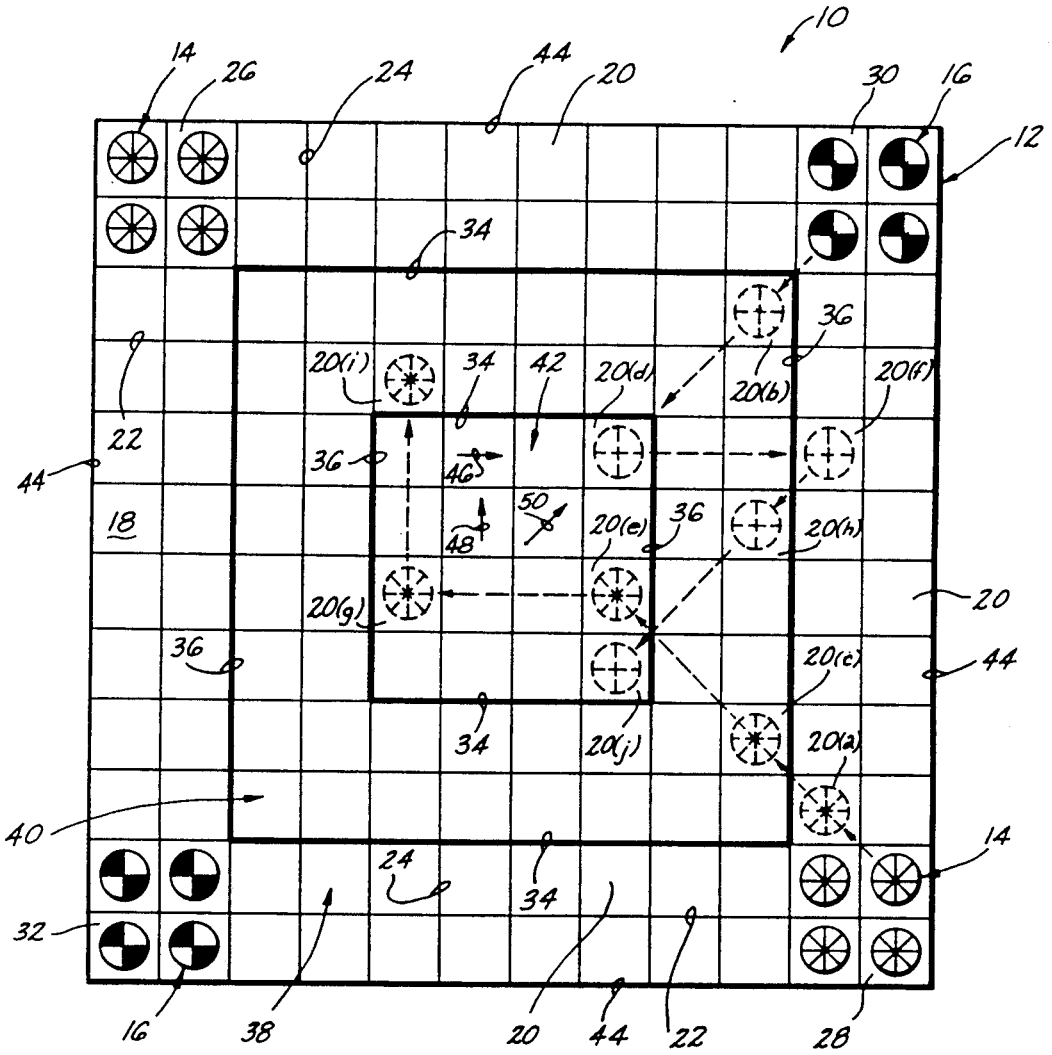
FIG. 1 is a top plan view of a board game apparatus of the present invention illustrating a game board having movable game pieces positioned on designated starter squares.

Referring now to the drawings, and more particularly to FIG. 1, a board game apparatus 10 of the present invention is illustrated. The board game apparatus 10 comprises a game board 12 and a plurality of movable game pieces 14 and 16. The game board 12 is provided with a substantially planar playing surface 18 which consists of a plurality of squares 20 defined by orthogonally disposed grid lines 22 and 24. That is, the grid lines 22 extend in a first direction and the grid lines 24 extend in a second direction which is substantially normal to the direction of the grid lines 22.

Four of the game pieces 14 are positioned on designated starter squares in corner 26 and four of the game pieces 14 are also positioned on designated starter squares in a diagonally disposed corner 28 of the game board 12. Similarly, four of the game pieces 16 are positioned on designated starter squares in corner 30 and four of the game pieces 16 are also positioned on designated starter squares in a diagonally disposed corner 32 of the game board 12. As will be described in more detail hereinafter, each of the game pieces 14 and 16 are individually movable, in player turn, selected distances along the game board 12 depending upon the position of the game pieces on the game board 12. That is, boundary markings, such as boundary markings 34 and 36, are coincident with selected grid lines 22 and 24, respectively, so as to divide the playing surface 18 of the game board 12 into a plurality of subset areas 38, 40 and 42.

Each of the subset areas 38, 40 and 42 is centered relative to an outer boundary 44 of the game board 12 (or playing surface 18); and each of the subset areas 38, 40, and 42 has a selected value which dictates the distance which the game pieces 14 and 16 can travel when it is the turn of a player to move one of the game pieces. That is, the subset area 38, which constitutes a perimeter subset area, is assigned a value of "1" so that the player is allowed to move (during his turn) one of his game pieces, such as one of the game pieces 14, one square in any direction provided that the direction is linear. The subset area 40, which constitutes an intermediate subset area, is assigned a value of "2" and the player is allowed to move one of his game pieces a distance of two squares in any direction, again provided that the direction of movement is linear. The subset area 42, which constitutes a center subset area, is assigned a value of "3" and thus the player moves one of his game pieces positioned on a square within the center subset area 42 a distance of three squares in any direction provided that the direction of the movement of the game piece is linear.

Thus, it will readily be understood that the positioning of the game pieces on the playing surface 18 of the game board 12 dictates the distance which a game piece can be moved, but not the direction of movement of the game piece. The direction of movement of the game piece, such as one of the game pieces 14, is solely within the discretion of the player and will be dependent to a large degree upon the objective sought by the player in achieving the winning goal of either capturing a majority of the opposing player's game pieces, or by aligning the game pieces within the center subset area 42 in either a first direction row (as indicated by the arrow 46); in an aligned second direction row (as indicated by the arrow 48); or in an aligned diagonal row (as indicated by the arrow 50).

Figure 2:
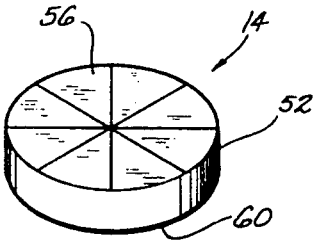
FIG. 2 is an isometric view of one of the movable game pieces of the board game apparatus of FIG. 1.
Figure 3A:
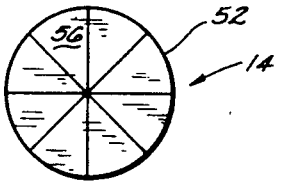
FIG. 3A is a top plan view of one game piece of the board game apparatus of the present invention depicting a a legend for game piece differentiation.
Figure 3B:
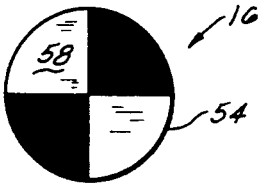
FIG. 3B is a top plan view of another game piece having a different legend than the legend on the game piece of FIG. 3A for game piece differentiation.

Referring now to FIGS. 2 and 3A, one of the game pieces 14 is illustrated; whereas in FIG. 3B one of the game pieces 16 is illustrated. The game pieces 14 and 16 are identical in construction with the exception that the game piece 14 is provided with a legend which distinguishes it from the game piece 16.

Each of the game pieces 14 is a disk shaped member 52 sized to be positioned within the boundaries of the squares 20 defined by the orthogonally disposed grid lines 22 and 24; and each of the game pieces 16 is a disk shaped member 54 sized to be positioned within the boundary of the squares 20 defined by the orthogonally disposed grid lines 22 and 24 substantially as shown in FIG. 1. An upper surface 56 of the disk shaped member 52 is provided with a legend, such as by coloration or marking, so as to impart uniqueness to the game pieces 14. Similarly, an upper surface 58 of the disk shaped member 54 is provided with a different legend, such as by coloration or marking so as to impart uniqueness to the game pieces 16. Each of the disk shaped members 52 and 54 is provided with a substantially planar lower surface, such as lower surface 60 of the disk shaped member 52, to enhance sliding movement of the disk shaped members 52 and 54 along the playing surface 18 of the game board 12. Further, it should be noted that, if one desires, each of the subset areas 38, 40 and 42 can be provided with a color indication so as to more clearly distinguish between each of such subset areas and thus enhance the detection of the value for each move when a game piece is located within the subset areas.

In order to provide an understanding of the use of the board game apparatus 10 as a game, a series of moves which players might make to achieve the winning goal will now be described with reference to FIG. 1. The game pieces will be described, as well as the direction of movement, with reference to such game pieces illustrated in phantom, and such game pieces illustrated in phantom will be distinguishable by their assigned legends as described above with reference to FIGS. 3A and 3B. It is to be understood that the movements described are merely illustrative for purposes of depicting the movement of the game pieces 14, 16 along the game board 12 in response to selected values determined by the particular subset area in which the game piece is located.

To prepare for play, one player arranges four of the game pieces 14 in the four squares of the corner 26 of the game board 12 and four of the game pieces 14 in the opposed corner 28. Similarly, the opponent places four of the game pieces 16 in the four squares of the corner 30 and four of the game pieces 16 in the corner 32. Thus, the game pieces 14 and 16 are arranged on the game board 12 substantially as shown. As previously stated, the objective of the game is for a player to align four of his game pieces in the center subset area 42 of the game board 12, or to capture a majority of his opponent's game pieces.

In playing the game the players alternately move one game piece during a turn, and capture occurs when a game piece is moved to land on a board position (square) occupied by the opponent's game piece. The distance a game piece travels in any one move is dependent upon the value of the subset area in which the game piece is positioned prior to the move. For example, as shown in FIG. 1, consider the player having the game pieces 14 to have the initial turn. Since the game pieces 14 are located in the perimeter subset area 38 which has a value of 1, one of the game pieces 14 can be moved one space or square so that one of the game pieces 14 now occupies the square designated 20*a*. The turn then passes to the opponent and the opponent's game pieces 16 are also located in the perimeter or subset area 38. Thus, the opponent can move one of the game pieces 16 one square so that the game piece 16 now occupies the square designated as 20*b*. It should be noted that by moving the particular game piece 16 as indicated the game piece 16 occupying the square 20*b* is now located in a square defined within the intermediate subset area 40; whereas the game piece 14 of the first player is still located in the perimeter subset area 38 when occupying the square 20*a*.

For the next move the first player moves the game piece 14 occupying square 20*a* one square so that the game piece 14 now occupies square 20*c*, a square within the intermediate subset area 40. The opponent can now move the game piece 16 occupying square 20*b* in a linear direction to square 20*d* which lies within the center subset area 42 of the game board 12. The first player now moves the game piece 14 from square 20*c* to square 20*e*, also a square located within the center subset area 42. It should be noted that the players in moving the game pieces 14 and 16 from square 20*c* and 20*b*, respectively, move the game pieces a distance of 2 squares in a linear diagonal direction as the position of the game pieces 14, 16 were in the intermediate subset area 40.

The opponent then determines that it is advisable to move the game piece 16 from the center subset area 42 and elects to move the game piece 16 in a lateral direction three squares from square 20*d* to square 20*f*. The first player then determines that the desired move is to move the game piece 14 from square 20*e* laterally in an opposite direction to square 20*g* to protect the game piece 14 from the game piece 16 of the opponent. The movement of the game piece 14 was a three square move because the game piece 14 was located in the center subset area 42 which has a movement value of "3".

Continuing with representative moves of the players, the second player now moves the game piece 16 from square 20*f* (which is located in the perimeter subset area 38) to square 20*h*. The second player can move the game piece 16 a distance of only one square because the game piece was located in the perimeter subset area 38 which has a movement value of "1".

The first player, upon detecting the strategy of the second player, then determines it to be in his best interest to move the game piece 14 in an upward or vertical direction to square 20*i*. The distance between the squares 20*g* and 20*i* is three squares, and the movement of the game piece 14 has been in a linear direction. Further, by moving the game piece 14 three spaces to square 20*i*, any subsequent move of the game piece 14 occupying square 20*i* will be for only two spaces, because the intermediate subset area 40 of the game board 12 in which the game piece is now positioned has a value of "2".

As a final illustration of the movement of the game pieces, the second player moves the game piece 16 from square 20*h* to square 20*j*, a square located within the center subset area 42 of the game board 12. The distance traveled between the squares 20*h* and 20*j* is two squares, such being determined by the value of the subset area in which the game piece 16 was located prior to the move. On the next move the second player can move the game piece 16 (which is occupying square 20*j*) three spaces since the game piece 16 is located within the center subset area 42 of the game board 12.

Each of the players continues to strategically move their respective game pieces in order to obtain the winning goal by either capturing five of the opponent's game pieces or by aligning four of the game pieces in a linear row within the center subset area 42 of the game board 12. While it has not been illustrated, it should be understood that during the course of moving a game piece a player may cause the game piece to jump over another of his game pieces or over an opponent's game piece with no effect on the game piece being jumped. However, a player cannot move one game piece to land in a square already occupied by another of his own game pieces.

From the above, it becomes clear that the board game apparatus of the present invention is a useful game apparatus which can be easily learned, while at the same time being intellectually challenging to the most discerning students of the game by providing each of the players with a stimulating exercise of mental competition. Further, the board game apparatus is played by players moving the game pieces in strategically calculated moves and such is the result of skill rather than by luck associated with such things as the roll of a die, the spin of a wheel or the draw of a card.

It is clear that the present invention is well adapted to carry out the objects and to attain the ends and advantages mentioned as well as those inherent therein. While a presently preferred embodiment has been described for the purposes of this disclosure, numerous changes may be made which will readily suggest themselves to those skilled in the art which are encompassed within the spirit of the invention disclosed and as defined in the appended claims.

What is claimed is:

1. A method for playing a game board apparatus wherein the game board apparatus consists of a game board having a playing surface and a predetermined number of movable game pieces, the playing surface consisting of a plurality of squares defined by orthogonally disposed grid lines which extend in first and second directions and boundary markings coincident with selected grid lines for dividing the playing surface into a plurality of subset areas of the playing surface, one of the subset areas being a perimeter subset area, a second subset area being an intermediate subset area and a third subset area being a center subset area, the method comprising:

assigning a movement value to each of the subset areas such that each subset area has a different movement value;

positioning movable game pieces on designated starter squares located in the perimeter subset area; and moving selected game pieces, in player turn, selected distances along the game board in one of the first direction, the second direction and a diagonal direction, the selected distance traveled being determined by the value of the subset area in which the game piece is located prior to being moved in order to attain one of a first winning goal and a second winning goal, the first winning goal being the capture of a majority of an opponent's game pieces by moving a game piece by coterminous moves to land on a square occupied by an opponent's game piece which results in capture of the opponent's game piece, the second winning goal being the first to position game pieces in one of an aligned first direction row, an aligned second direction row and an aligned diagonal row in the third subset area by coterminous moves of one's game pieces.

2. The method of claim 1 wherein the step of positioning movable game pieces comprises positioning sixteen such game pieces on the designated starter squares, eight of the game pieces having a first identifying legend and eight of the game pieces having a second identifying legend, and wherein each of the movable game pieces is a disk shaped member having an upper surface and a substantially planar lower surface and wherein one of the first and second identifying legends is positioned on at least the upper surface of each of the disk shaped members.

* * * * *